US006305815B1

(12) United States Patent
Lin

(10) Patent No.: US 6,305,815 B1
(45) Date of Patent: Oct. 23, 2001

(54) SCREWDRIVER HAVING A BIT SET SLIDABLY RECEIVED IN A HANDLE OF THE SCREWDRIVER

(75) Inventor: Ming-Nee Lin, Taichung Hsien (TW)

(73) Assignee: Home Soon Enterprise Co., Ltd. (TW)

( * ) Notice: Subject to any disclaimer, the term of this patent is extended or adjusted under 35 U.S.C. 154(b) by 0 days.

(21) Appl. No.: 09/507,735

(22) Filed: Feb. 22, 2000

(51) Int. Cl.[7] ..... B25B 23/18; B25G 1/08

(52) U.S. Cl. ..... 362/119; 362/120; 81/177.4; 81/490

(58) Field of Search ..... 362/119, 120, 362/253, 234; 81/490, 177.4

(56) References Cited

U.S. PATENT DOCUMENTS 4,227,430 * 10/1980 Jansson et al. ..... 81/177.4
5,265,504 * 11/1993 Fruhm ..... 81/438
5,566,596 * 10/1996 Lin ..... 81/177.4
5,740,706 * 4/1998 Tseng ..... 81/490
5,799,552 * 9/1998 Curtis ..... 81/490
5,873,648 * 2/1999 Shiao ..... 362/119
5,881,615 * 3/1999 Dahl et al. ..... 81/490
5,913,596 * 6/1999 Lin ..... 362/120

* cited by examiner

*Primary Examiner*—Thomas M. Sember

(57) ABSTRACT

A screwdriver includes a hollow handle in which a bit set is slidably received and the bit set receives bits. A shank extends from a front end of the handle. A first end of the bit set is connected to a head member and a second end of the bit set is connected to a cap which is rotatably and disengagably connected to a rear end of the handle. A limit ring extends radially inward from the inside of the handle so that when the bit set is pulled from the handle to a position where the head member is stopped by the limit ring.

15 Claims, 11 Drawing Sheets

SCREWDRIVER HAVING A BIT SET SLIDABLY RECEIVED IN A HANDLE OF THE SCREWDRIVER

FIELD OF THE INVENTION

The present invention relates to a screwdriver which has a shank extending from a front end of a handle of the screwdriver and a bit set for receiving bits is slidably received in the handle.

BACKGROUND OF THE INVENTION

A conventional screwdriver generally includes a handle and a shank extending from a front end of the handle. The shank has an engaging hole defined in a distal end of the shank so that different bits can be engaged with the engaging hole of the shank and perform different functions. The screwdriver is convenient for the user to carry and bits can be easily replaced and engaged with the shank. However, the bits are received in a box and the box is independent from the screwdriver so that the user has to carry the bit box and the screwdriver. A cartridge type screwdriver is developed and disclosed in U.S. Pat. No. 5,265,504 to Fruhm, with the title of "Cartridge Type Screwdriver". The shank of the cartridge type screwdriver includes a neck portion which is securely engaged with a passage of the handle. The engagement between the neck portion and the passage requires a large mold set to manufacture and complicated checking processes to position the neck portion in the passage so that the screwdriver is incurred by high manufacturing cost. The shank is made of metal and has the same length as the handle so that each screwdriver employs a certain amount of metal which makes the price of the screwdriver be high. Besides, the magazine has no proper support when it is pulled out from the handle.

The present invention intends to provide a screwdriver having a bit set slidably received in the handle and the bit set is well positioned when it is pulled from the handle.

SUMMARY OF THE INVENTION

In accordance with one aspect of the present invention, there is provided a screwdriver and comprising a hollow handle having a shank extending from a first end of the handle and a cap rotatably and removably engaged with a second end of the handle. A bit set is received in the handle and connected to the cap. The bit set has a central column and a plurality of clamping plates are radially connected to the central column so as to receive bits. A head member is connected to a first end of the central column and the head member is movably engaged with the inner periphery of the handle. A limit ring extends radially inward from an inner periphery of the handle and the head member will be stopped by the limit ring when the bit set is pulled from the second end of the handle.

The object of the present invention is to provide a screwdriver that includes a hollow handle with a slidable bit set received therein and the bit set has a head member connected thereto so that it is well supported during pulling from the handle.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
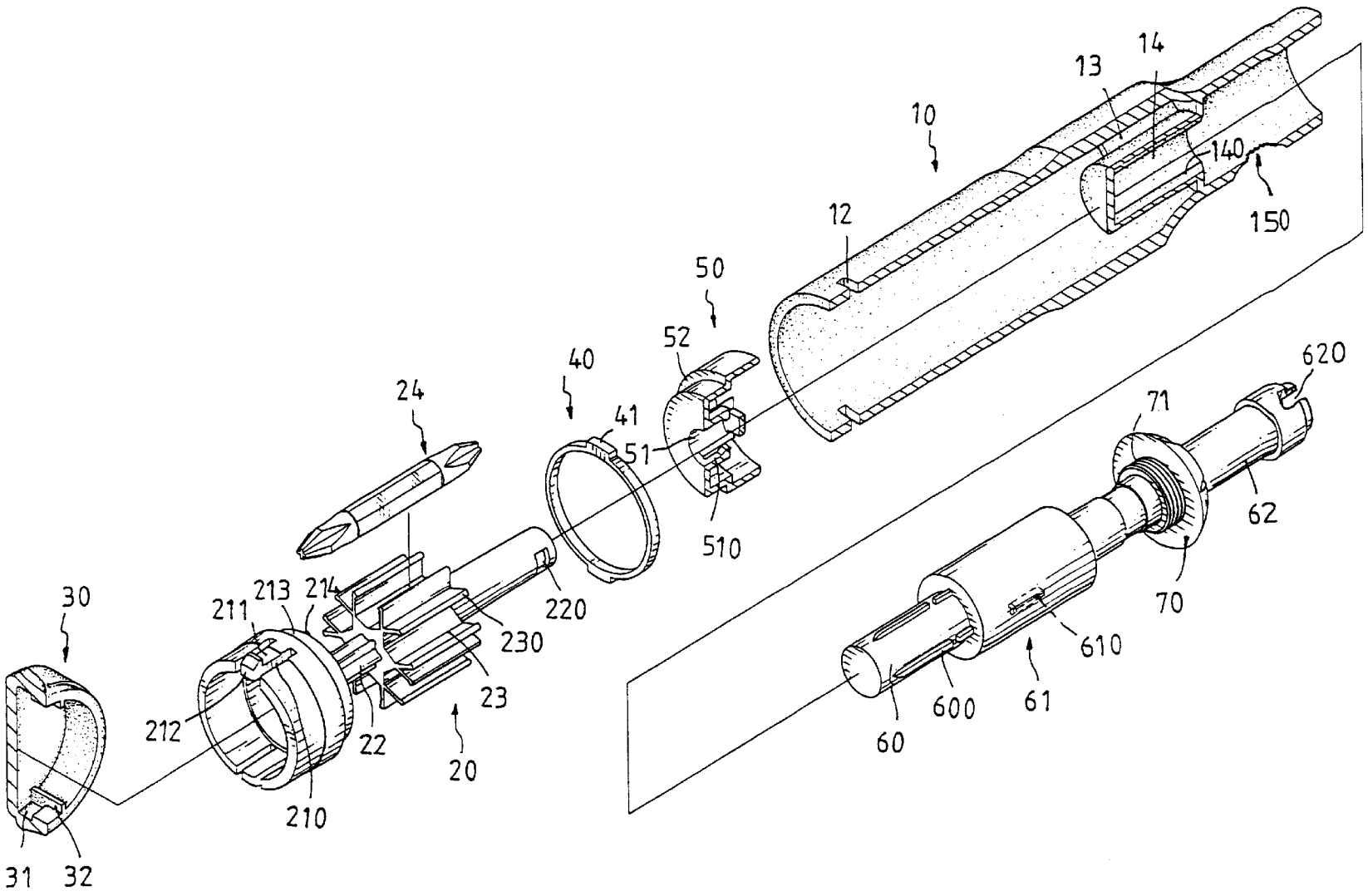
FIG. 1 is an exploded view to show a screwdriver in accordance with the present invention.
Figure 2:
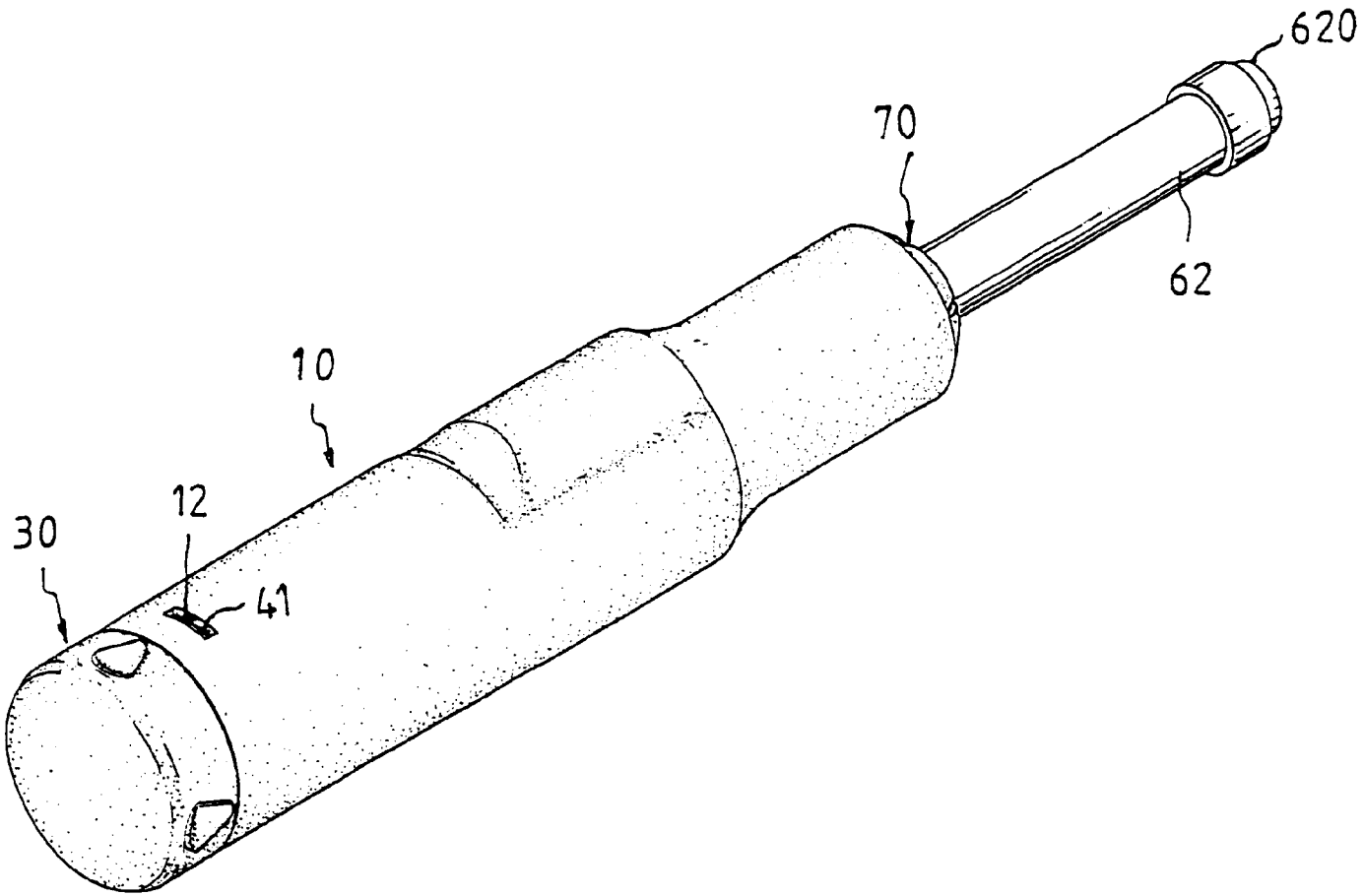
FIG. 2 is a perspective view to show the screwdriver of the present invention.
Figure 3:
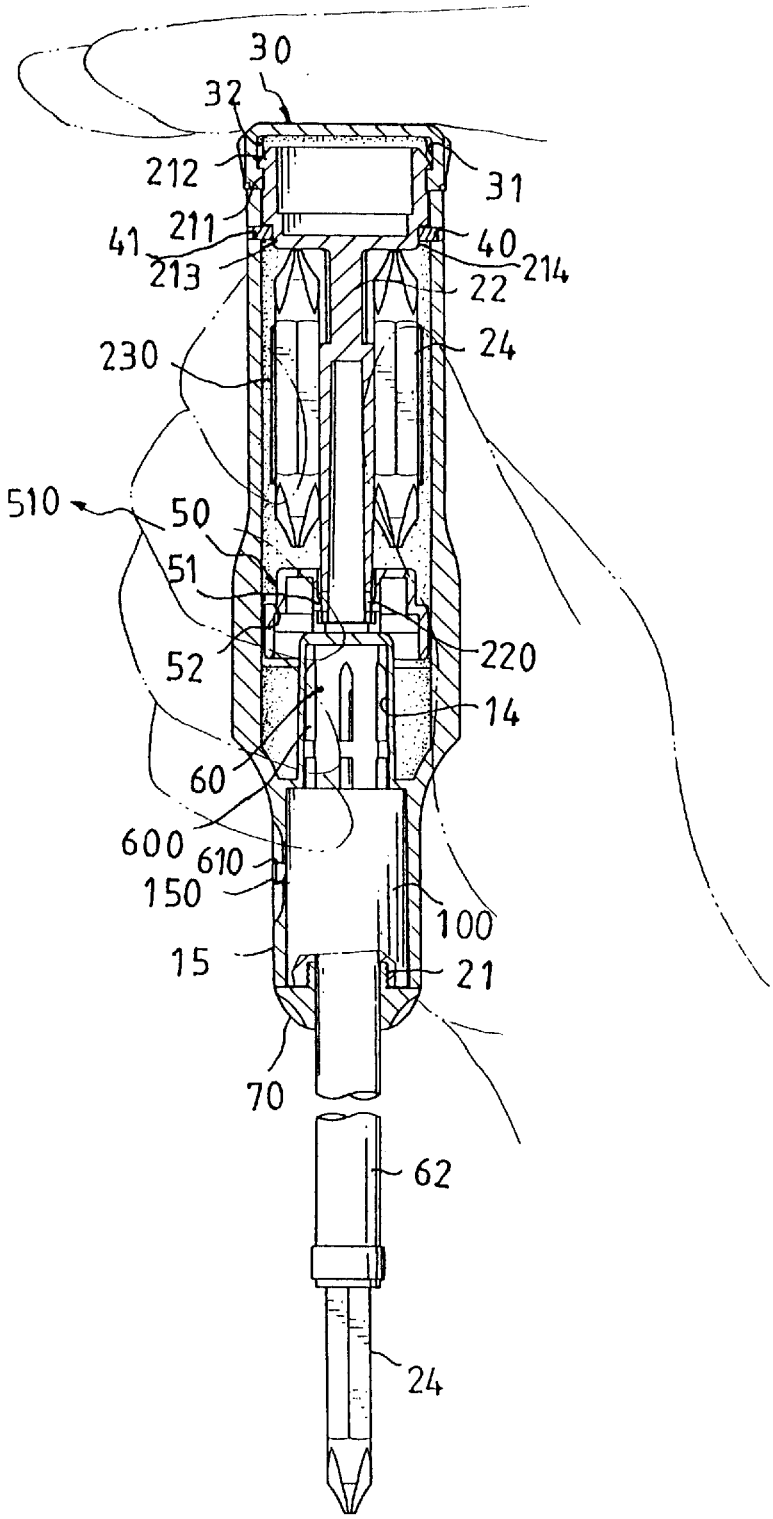
FIG. 3 is a side elevational view, partly in section, of the screwdriver, wherein a bit is connected to the shank of the screwdriver.

Referring to FIGS. 1 to 3, the screwdriver in accordance with the present invention comprises a hollow handle 10 having a shank 62 extending from a first end of the handle 10 and a cap 30 rotatably and removably engaged with a second end of the handle 10. A bit set 20 is slidably received in the handle 10. Two holes 12 are defined radially through the handle 10 and located close to the second end of the handle 10, a limit ring 40 having two protrusions 41 extending radially outward therefrom is engaged with an inner periphery of the handle 10 so that the two protrusions 41 are engaged with the two holes 12. The limit ring 40 extends radially inward from the inner periphery of the handle 10.

A tube 14 is located longitudinally in the handle 10 and a plurality of plates 13 connected between the tube 14 and the inner periphery of the handle 10 so that the tube 14 is located in the handle 10 and located close to the first end of the handle 10. The tube 14 has a closed end and an open end which communicates with the first end of the handle 10. The tube 14 has a plurality of grooves 140 defined longitudinally in an inner periphery thereof. A first end 60 of a shank 62 is securely received in the tube 14. The first end 60 of the shank 62 has a plurality of ridges 600 extending radially outward therefrom so that the ridges 600 are engaged with the grooves 140. Accordingly, the shank 62 is co-rotatable with the handle 10. A ratchet mechanism 61 is cooperated with the shank 62 and has a switch button 610 on an outside of the ratchet mechanism 61. An access hole 150 is defined radially through the handle 10 close to the first end of the handle 10 so that the switch button 610 can be accessed via the access hole 150 by the user. A flange 70 extends radially outward from the shank 72 and the flange 70 is engaged with the first end of the handle 10. A tubular member 100 is located in the first end of the handle 10 and the tubular member 100 has an inner threaded periphery. The shank 62 has a threaded section 71 which is engaged with the inner threaded periphery in the tubular member 100 to make sure that the flange 70 seals the first end of the handle 10. An engaging hole 620 is defined in a distal end of the shank 62 so as to engage with a bit 24.

The bit set 20 has a central column 22 and a plurality of clamping plates 230 are radially connected to the central column 22 so as to define a plurality of clamping recesses 23 that hold bits 24 therein. A head member 50 is connected to a first end of the bit set 20 and the head member 50 is movably engaged with the inner periphery of the handle 10. The head member 50 has a recess 51 defined in an end thereof and the first end of the central column 22 is securely received in the recess 51. Two slots 220 are defined radially through the first end of the central column 22 and two snap members 510 are located at an inside of the recess 51 of the head member 50 so that the snap members 510 are engaged with the slots 220. The head member 50 has a shoulder portion 52 extending radially outward from an outside of the head member 50.

Figure 4:
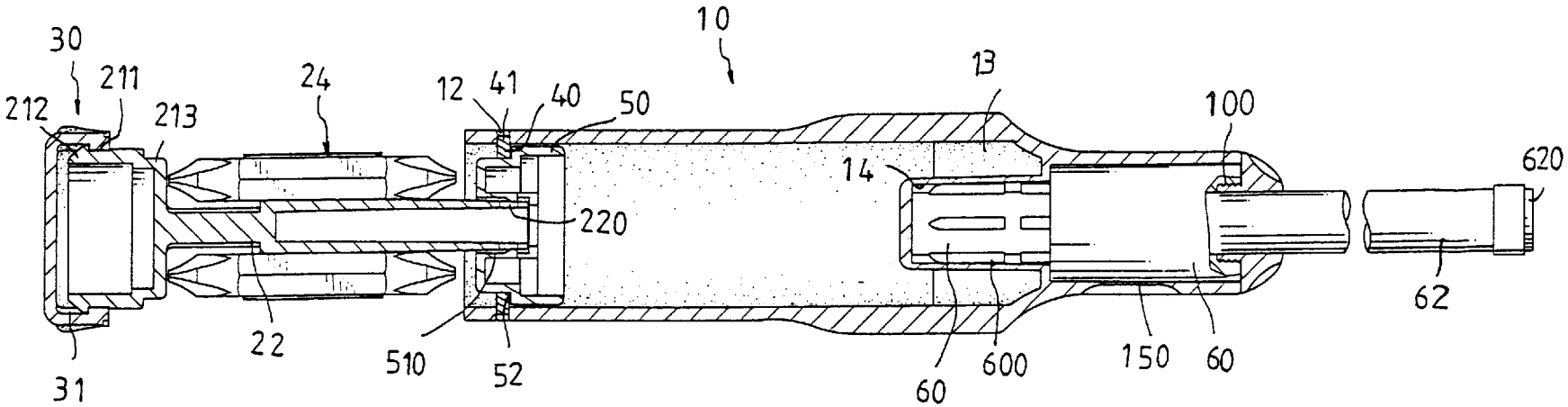
FIG. 4 is a side elevational view, partly in section, of the screwdriver, wherein a bit set is pulled from the handle of the screwdriver.
Figure 5:
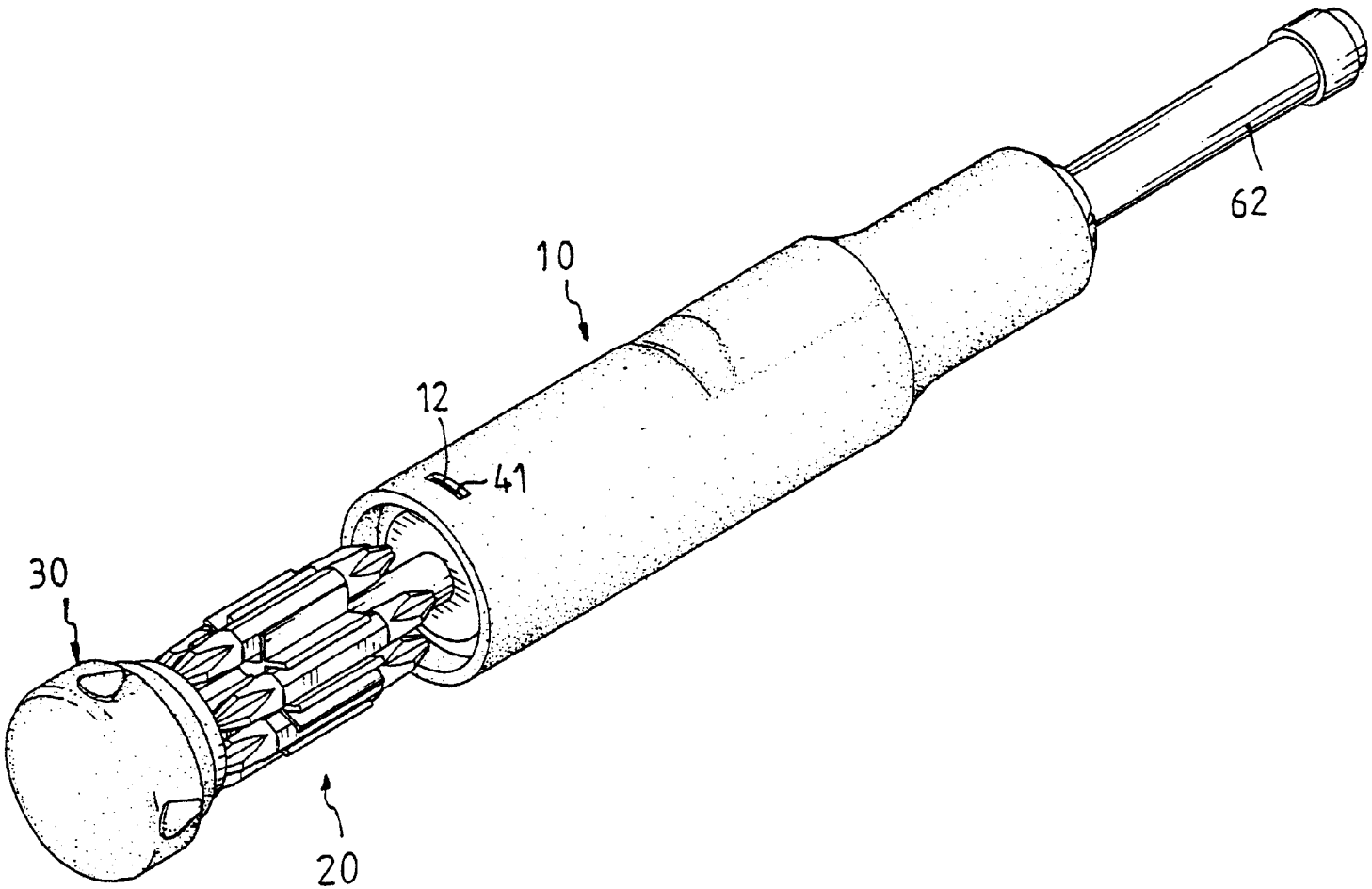
FIG. 5 is a perspective view to show the bit set and the screwdriver.

A second end of the bit set 20 is rotatably connected to the cap 30 which has a skirt portion and two ribs 32 extend radially inward from an inner periphery of the skirt portion. A stepped block 31 extends from the inner periphery of the skirt portion of the cap 30 and is located between the two ribs 32. The second end of the central column 22 is connected to a cup member 21 and has two slits 210 defined longitudinally therein. The two ribs 32 are engaged with the two slits 210. A flexible hook 211 is defined between the two slits 210 and engaged with the stepped block 31 so that the cap 30 is rotatable independently from the handle 10. The cup member 21 further has a stepped portion 213 that is engaged with the limit ring 40 when the bit set 20 is received in the handle 10. As shown in FIGS. 4 and 5, the bit set 20 can be pulled from the second end of the handle 10 by pulling the cap 30 till the shoulder portion 52 of the head member 50 is engaged with the limit ring 40. The bit set 20 is well supported because the head member 50 is engaged with the inner periphery of the handle 10. A boss 214 extends radially outward from the stepped portion 213 of the cup member 21 so that when the bit set 20 is pushed into the handle 10, the boss 214 is forced to move across an inner periphery of the limit ring 40 to notify the user that the bit set 20 is completely received in the handle 10.

Figure 6:
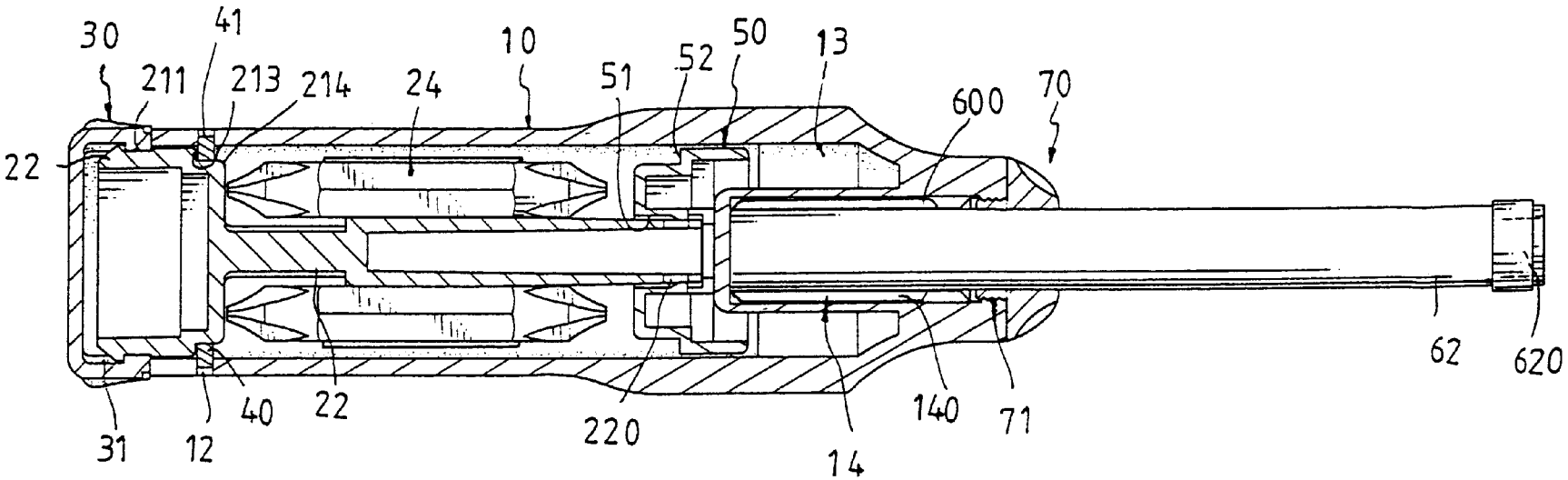
FIG. 6 is a side elevational view, partly in section, of the screwdriver, wherein another type of shank without ratchet mechanism is connected to the screwdriver.

FIG. 6 shows that the shank 62 can be a general shank 62 that has an engaging hole 620 in a distal end thereof and has no ratchet mechanism.

Figure 7:
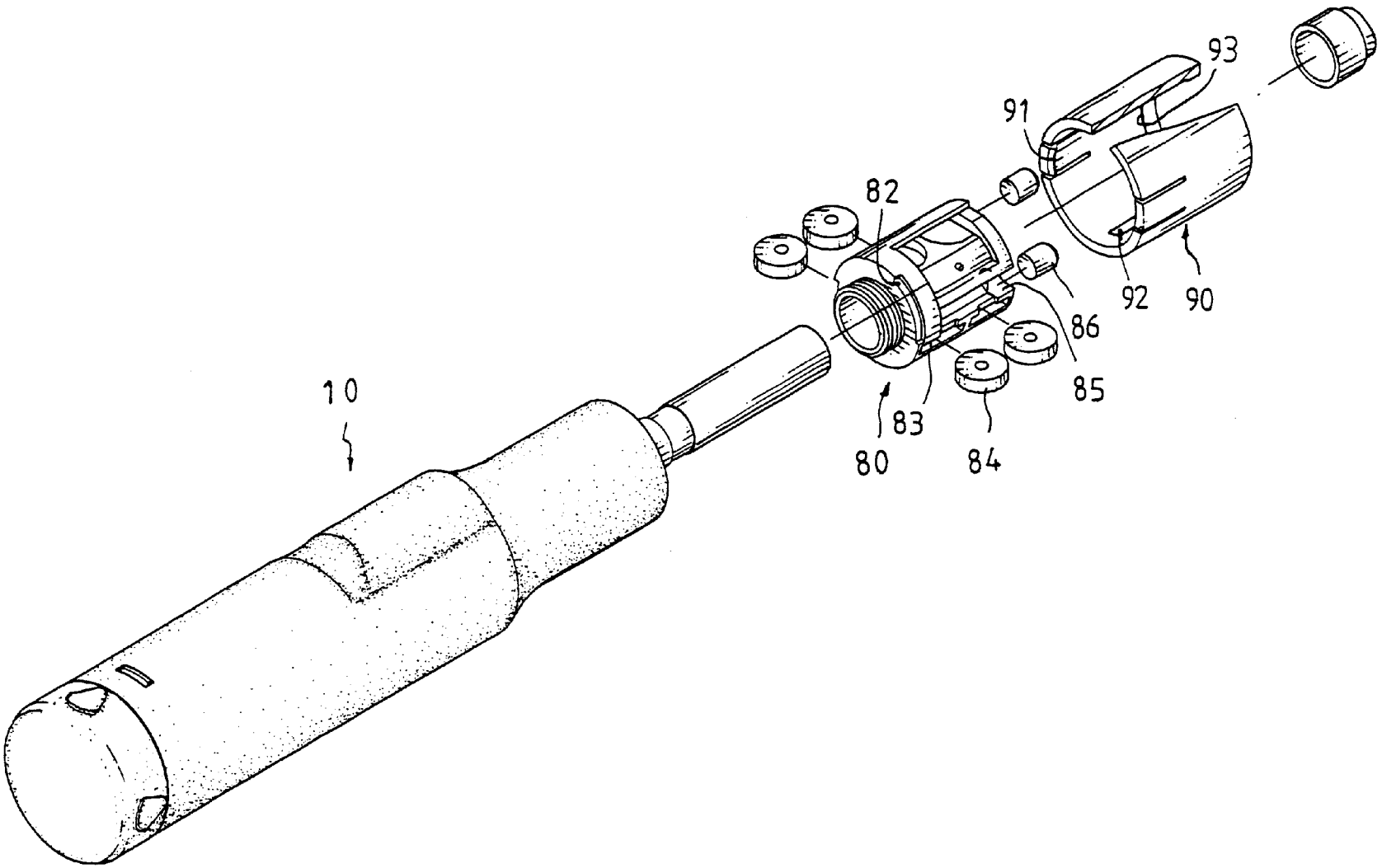
FIG. 7 is an exploded view to show the screwdriver in accordance with the present invention and a light device mountable to the shank.
Figure 8:
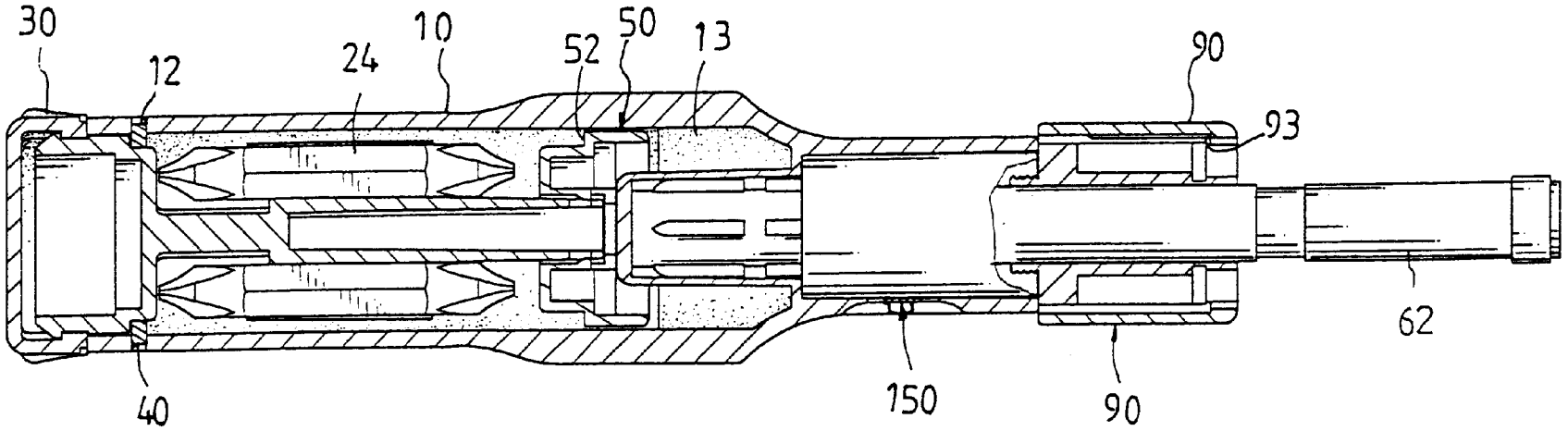
FIG. 8 is a side elevational view, partly in section, of the screwdriver, wherein the light device is mounted to a shank with a ratchet mechanism.
Figure 9:
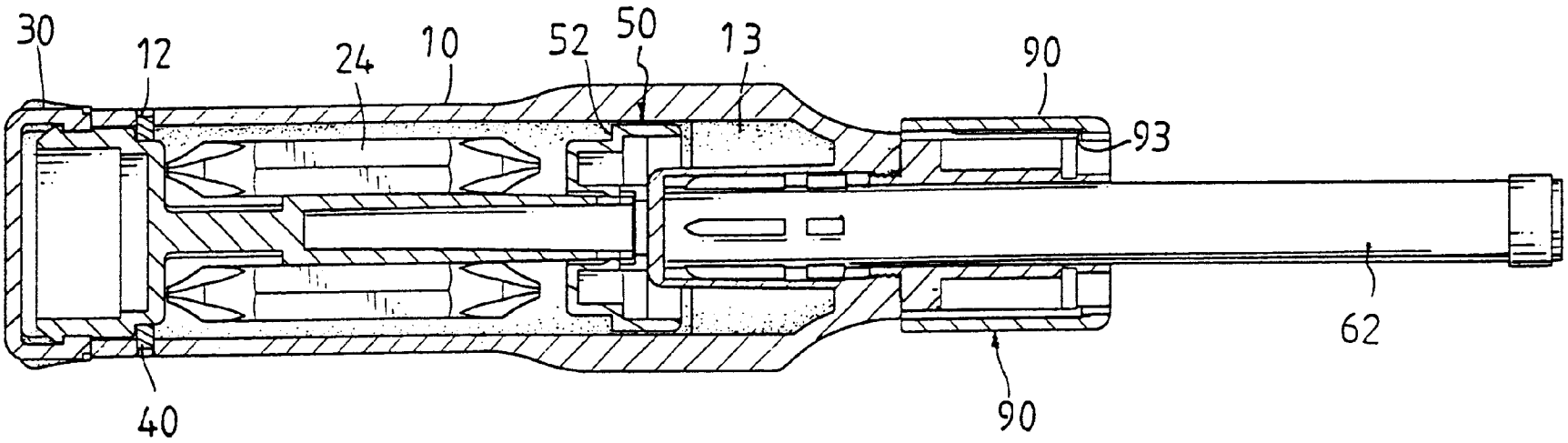
FIG. 9 is a side elevational view, partly in section, of the screwdriver, wherein the light device is mounted to a shank without a ratchet mechanism.

FIGS. 7 and 8 shows that a light device 80 is securely mounted to the shank 62 and a sleeve 90 is rotatably mounted to the light device 80. The light device 80 has batteries 84 received in recesses 83 in an outside of the light device 90 and two bulbs 86 are engaged with the light device 80. Two curved notches 82 are defined in an end of the light device 80 and the sleeve 90 has two hooks 91 located in one end thereof so that the two hooks 91 are movably engaged with the two curved notches 82. A lip 93 extends radially inward from the other end of the sleeve 90 to engage with the other end of the light device 80. The sleeve 90 has a conductive plate 92 connected to an inner periphery thereof so that when rotating the sleeve 90 to contact the conductive plate 92 and the batteries 84, the bulbs 86 turn on. FIG. 9 shows that the shank 62 has no ratchet mechanism cooperated therewith.

Figure 10:
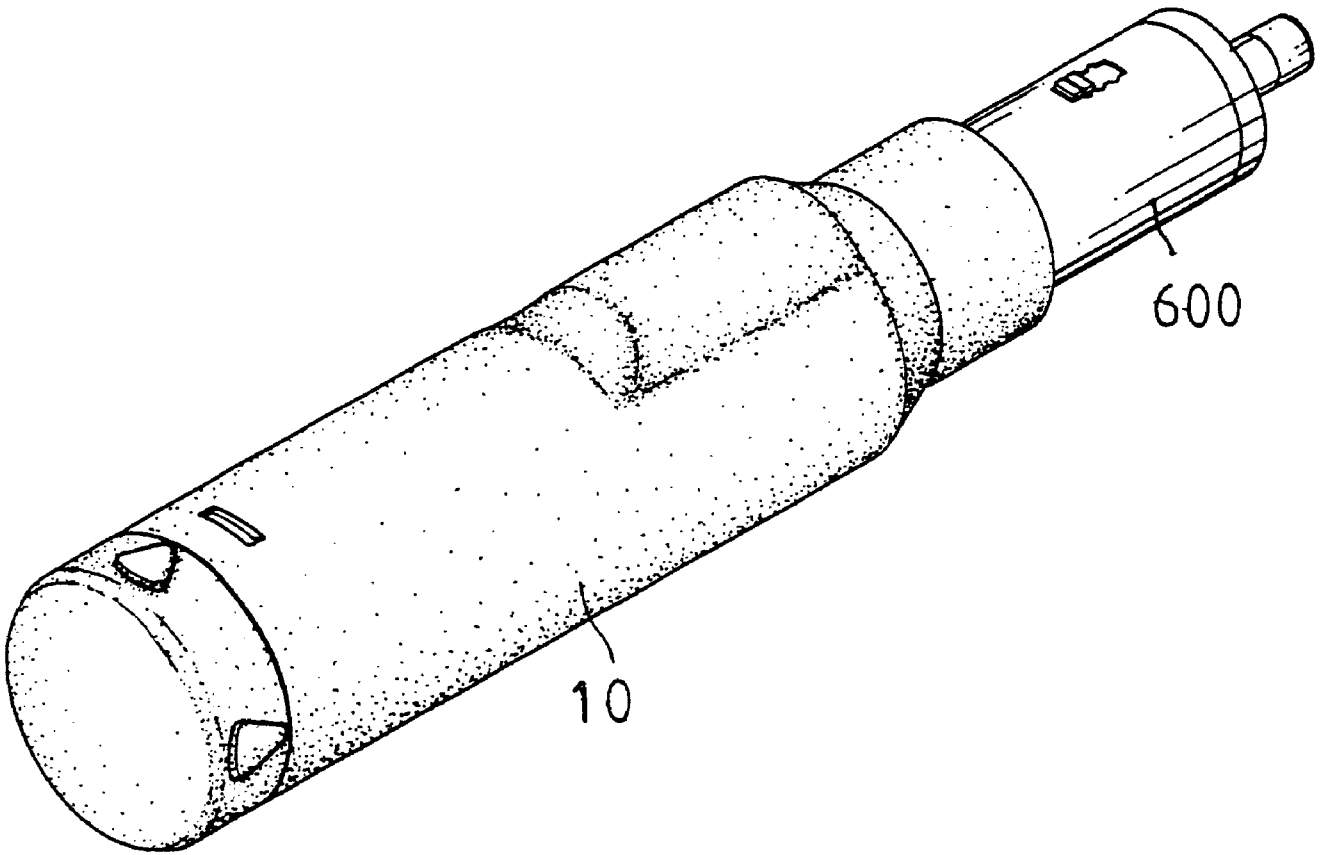
FIG. 10 is a perspective view to show another embodiment of the screwdriver that has another type of ratchet mechanism connected thereto.
Figure 11:
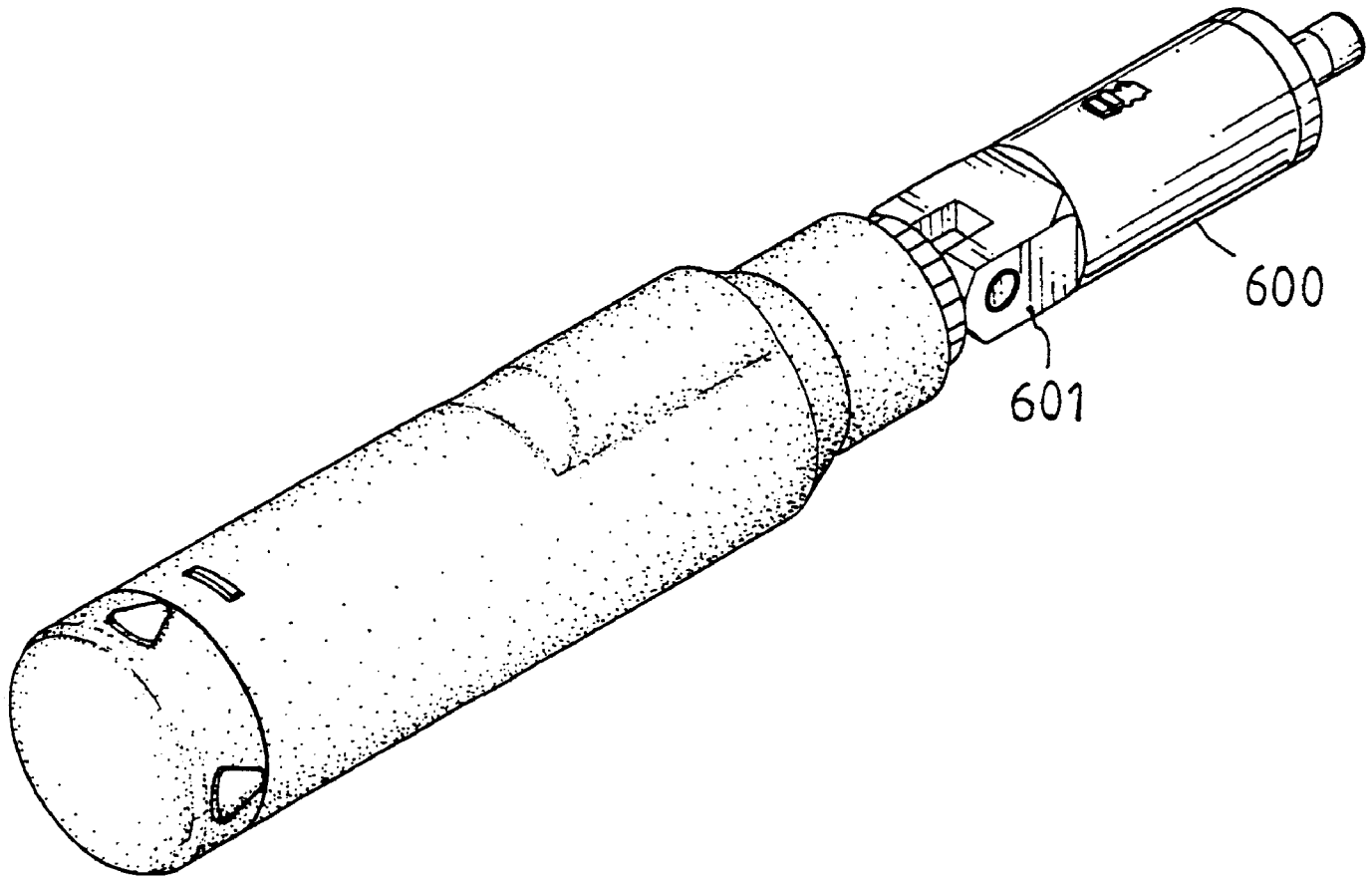
FIG. 11 is a perspective view to show yet another embodiment of the screwdriver wherein a universe joint is used to connect to the ratchet mechanism as shown in FIG. 10.

FIG. 10 shows that another type of ratchet mechanism 600 is connected to the handle 10 and FIG. 11 shows a universe joint 601 is used to connect to the ratchet mechanism 600.

While we have shown and described various embodiments in accordance with the present invention, it should be clear to those skilled in the art that further embodiments may be made without departing from the scope and spirit of the present invention.

What is claimed is:

1. A screwdriver comprising:

a hollow handle having a shank extending from a first end of said handle and a cap rotatably and removably engaged with a second end of said handle, a limit ring extending radially inward from an inner periphery of said handle;

a bit set received in said handle, a head member connected to a first end of said bit set and said head member is movably engaged with said inner periphery of said handle, a second end of said bit set rotatably connected to said cap, said head member being stopped by said limit ring when said bit set is pulled from said second end of said handle.

2. The screwdriver as claimed in claim 1, wherein said bit set has a central column and a plurality of clamping plates are radially connected to said central column so as to be adapted to receive bits.

3. The screwdriver as claimed in claim 2, wherein said head member has a recess defined in an end thereof and said first end of said central column is securely received in said recess.

4. The screwdriver as claimed in claim 3, further comprising two slots defined radially through said first end of said central column and two snap members located at an inside of said recess of said head member so that said snap members are engaged with said slots.

5. The screwdriver as claimed in claim 1, wherein said head member has a shoulder portion extending radially outward from an outside of said head member, said shoulder portion engaged with said limit ring when said bit set is pulled out from said handle.

6. The screwdriver as claimed in claim 1, wherein said cap has a skirt portion and two ribs extend radially inward from an inner periphery of said skirt portion, a stepped block extending from said inner periphery of said skirt portion of said cap and located between said two ribs, said second end of said central column connected to a cup member and having two slits defined longitudinally therein, said two ribs engaged with said two slits, a flexible hook defined between said two slits and engaged with said stepped block.

7. The screwdriver as claimed in claim 1 further comprising two holes defined radially through said handle and said limit ring having two protrusions extending radially outward therefrom, said two protrusions engaged with said two holes.

8. The screwdriver as claimed in claim 6, wherein said cup member has a reduced stepped portion and a boss extends radially outward from the stepped portion of the cup member, said boss being forced to move across an inner periphery of said limit ring when said bit set is received in the handle.

9. The screwdriver as claimed in claim 1 further comprising a tube located longitudinally in said handle and a plurality of plates connected between said tube and said inner periphery of said handle, said tube having a closed end and an open end which communicates with said first end of said handle, a first end of said shank securely received in said tube.

10. The screwdriver as claimed in claim 9, wherein said tube has a plurality of grooves defined in an inner periphery thereof and said first end of said shank has a plurality of ridges extending radially outward therefrom, said ridges engaged with said grooves.

11. The screwdriver as claimed in claim 1 further comprising a flange extending radially outward from said shank and said flange engaged with said first end of said handle.

12. The screwdriver as claimed in claim 11 further comprising a tubular member located in said first end of said handle and said tubular member having an inner threaded periphery, said shank having a threaded section which is engaged with said inner threaded periphery in said tubular member.

13. The screwdriver as claimed in claim 1 further comprising a light device securely mounted to said shank and a sleeve rotatably mounted to said light device.

14. The screwdriver as claimed in claim 13, wherein said light device has two curved notches defined in an end thereof and said sleeve has two hooks located in one end thereof, said two hooks movably engaged with said two curved notches.

15. The screwdriver as claimed in claim 13, wherein said sleeve has a conductive plate connected to an inner periphery thereof.

* * * * *